United States Patent [19]

Takenaka et al.

[11] Patent Number: 4,692,659

[45] Date of Patent: Sep. 8, 1987

[54] COLOR CATHODE RAY TUBE HAVING SHADOW MASK WITH SILICON

[75] Inventors: Shigeo Takenaka; Norio Koike; Takeo Itou; Hidemi Matsuda, all of Fukaya, Japan

[73] Assignee: Kabushiki Kaisha Toshiba, Kawasaki, Japan

[21] Appl. No.: 843,247

[22] Filed: Mar. 24, 1986

[30] Foreign Application Priority Data

Mar. 27, 1985 [JP] Japan ..... 60-60908

[51] Int. Cl.[4] ..... H01J 29/07

[52] U.S. Cl. ..... 313/402; 313/407

[58] Field of Search ..... 313/402, 407; 445/47

[56] References Cited

U.S. PATENT DOCUMENTS 3,760,214 9/1973 Yamazaki et al. ..... 313/402

4,306,172 12/1981 Matsukura et al. ..... 313/402

4,558,252 12/1985 Kanto et al. ..... 313/402

FOREIGN PATENT DOCUMENTS 50-115766 9/1975 Japan .

*Primary Examiner*—Palmer C. DeMeo

*Assistant Examiner*—Sandra L. O'Shea

*Attorney, Agent, or Firm*—Oblon, Fisher, Spivak, McClelland, & Maier

[57] ABSTRACT

In a color cathode ray tube provided with in-tube metallic members of which the main constituent is iron, such as the shadow mask assembly or inner shield, at least part of the surface of these metallic members is formed with a blackened region. The vicinity of the surface of this blackened region contains Al, Fe and Si, the Si content being selected in the range 1.5 wt % to 30 wt %, preferably 4 wt % to 15 wt %.

4 Claims, 7 Drawing Figures

COLOR CATHODE RAY TUBE HAVING SHADOW MASK WITH SILICON

BACKGROUND OF THE INVENTION

This invention relates to a color cathode ray tube, and more particularly to a blackened surface construction of its metallic members whose main constitutent is iron, such as the shadow mask assembly or the inner shield.

A color cathode ray tube has an envelope provided with a panel having a phosphor screen essentially consisting of a mosaic of phosphors emitting red, green, and blue light, a neck housing an electron gun, and a funnel that connects the panel and the neck.

The electron beams emitted from the electron gun are selectively allowed to pass through to the screen by arranging, facing the phosphor screen, a shadow mask provided with a large number of apertures.

However, when these electron beams are subjected to the effect of an external magnetic field such as the earth's magnetic field, in particular in the vicinity of the shadow mask, the trajectories of the electron beams are disturbed, resulting in landing errors on the phosphor screen. Further problems are caused by the fact that the proportion of the electron beams which passes through the apertures of the shadow mask is only about 20%. The rest of the electrons in the beams, i.e. the electrons that do not pass through the apertures, are elastically reflected by the shadow mask, causing heating of the shadow mask and undesired emission of light from the phosphor screen.

To solve these problems use is made of an inner shield. The inner shield is fixed on the funnel side of the shadow mask. The material of the inner shield is required to have high permeability, to be electrically conductive, to have good forming properties, high mechanical strength and not to develop rust during the manufacturing process. Soft steel sheet is iron is therefore usually used for this purpose.

Regarding the reflective scattering of the electron beam and heating of the shadow mask, to suppress the radiation of secondary electrons and to confer black body radiation characteristics, the surfaces of the shadow mask assembly and/or inner shield are subjected to oxidative treatment to form a blackened film. This blackened film also serves to prevent rust.

On the other hand, this blackened film itself gives rise to some problems such as poor withstand voltage characteristics and/or blockage of the apertures of the shadow mask caused by peeling of this blackened film, areas of lowered contrast due to insufficient suppression of scattered electrons, or reduced emission life due to production of gaseous impurities when the mask is struck by the electron beams.

As a substitute for the blackened film of iron oxide, Japanese Patent Application Laid Open No. 50-15766 discloses an attempt to obtain a black Fe-Al alloy surface by attaching aluminium to the surface of an iron inner shield and dispersing the aluminium in the surface of the inner shield by subjecting it to heat treatment. With this set-up, there is some improvement in respect of the problem of film peeling, but there is no improvement in respect of emission life, which is reduced by gaseous impurities generated by the impingement of the electron beams.

SUMMARY OF THE INVENTION

One object of this invention is to provide a color cathode ray tube wherein loss of contrast due to scattered electrons is suppressed and emission life is increased.

According to this invention, a color cathode ray tube comprises a panel formed with a phosphor screen on its inside face;

- a neck has an electron gun assembly facing the phosphor screen;
- a funnel joins the neck to the panel to constitute an envelope;
- a shadow mask assembly comprises a shadow mask arranged close to and facing the electron gun side of said phosphor screen and a mask frame supporting the shadow mask; and
- an inner shield extends on the electron gun side from this shadow mask assembly along the inner face of the funnel.

Iron is the main constituent of said shadow mask assembly and the inner shield and at least one surface thereof is provided with a blackened region containing Al, Fe and Si, and the Si content in the surface vicinity of the blackened region is greater than 1.5 wt% and less than 30 wt%.

If the Si content is less than 1.5 wt%, there is no improvement in residual emission; if it is more than 30 wt%, peeling of the blackened region tends to occur. More preferably the Si content is selected from 4.0 wt% to 15 wt%.

DETAILED DESCRIPTION OF THE PREFERRED EMBODIMENT

An embodiment of this invention will now be described with reference to FIGS. 1 to 5.

Figure 1:
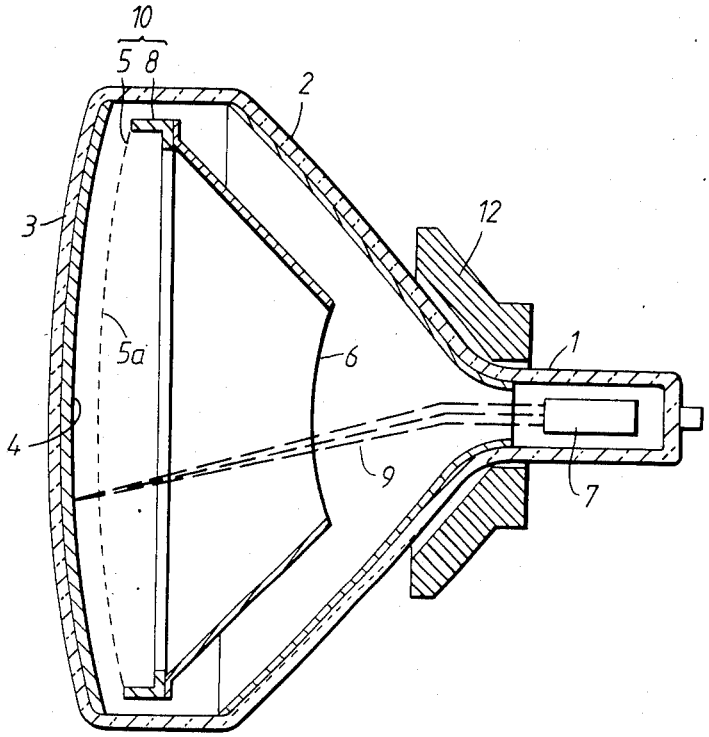
FIG. 1 is a cross sectional view of the construction of a color cathode ray tube according to an embodiment of this invention.
Figure 2:
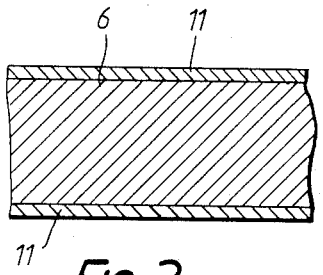
FIG. 2 is a partial cross-sectional view of the inner shield shown in FIG. 1.

FIG. 1 and FIG. 2 show the construction of a color cathode ray tube according to this invention.

The color cathode ray tube comprises an envelope formed by a panel 3 provided with a phosphor screen 4 formed with separate groups of phosphors that emit red, green and blue light respectively, and neck 1 facing phosphor screen 4, to which it is joined by a funnel 2, and housing an electron gun assembly 7 that emits three electron beams, within the envelope is arranged a shadow mask assembly 10 consisting firstly of shadow mask 5 next to phosphor screen 4 and having a large number of electron beam apertures 5*a*, and secondly of a mask frame 8 that supports this shadow mask 5 at its edges. An inner shield 6 extends along the inside face of funnel 2 from this shadow mask assembly 10 towards electron gun 7. Inner shield 6 is provided to prevent bending of the electron beams by the earth's magnetism. In such a color cathode ray tube, the three electron beams 9 emitted, accelerated and focussed by electron gun assembly 7 are scanned by means of a deflection yoke 12 arranged outside the funnel. The electron beams are condensed in the vicinity of the apertures 5a of shadow mask 5 and then diverge from these apertures. The color picture is produced by the emission of light which occurs when the electron beams selectively land on the red, green and blue phosphors of phosphor screen 4.

Blackened regions 11 are formed on the surface of the metal members, such as shadow mask assembly 10 and inner shield 6, which are in the tube and whose main constituent is Fe. Blackened regions 11 according to this embodiment of the invention enhance radiation of heat and suppress production of secondary electrons and have a rust-preventive effect. In addition, they give an improved emission life.

The formation of such a blackened regions 11 on inner shield 6 is described below.

First of all, the surface of the soft steel sheet which provides the substrate is cleaned with acid and cold rolled, then plated with molten aluminium. The aluminium material that is used for this plating with molten aluminium contains at least 0.5 to 15 wt% of Si. The plating thickness produced is about 10 micron to 20 micron.

Next cold rolling is again performed to obtain the prescribed sheet thickness and the sheet is softened by annealing. The sheet is then formed to required shape in a cutting press and the blackened region is formed by heat treatment in a reducing atmosphere, for example a hydrogen atmosphere, or in vacuum.

A blackened region formed by heat treatment in reducing atmosphere as described above was found to have the following characteristics.

First of all, on observing the surface of the blackened region using an electron microscope, it was found to be much more uneven than an ordinary iron oxide blackened surface film.

Next, by composition analysis carried out by an electron-beam microanalyser at a depth of from 1 to 5 micron from the surface of the blackened film, it was found that Si and Al etc. were present essentially in metallic form.

Figure 4:
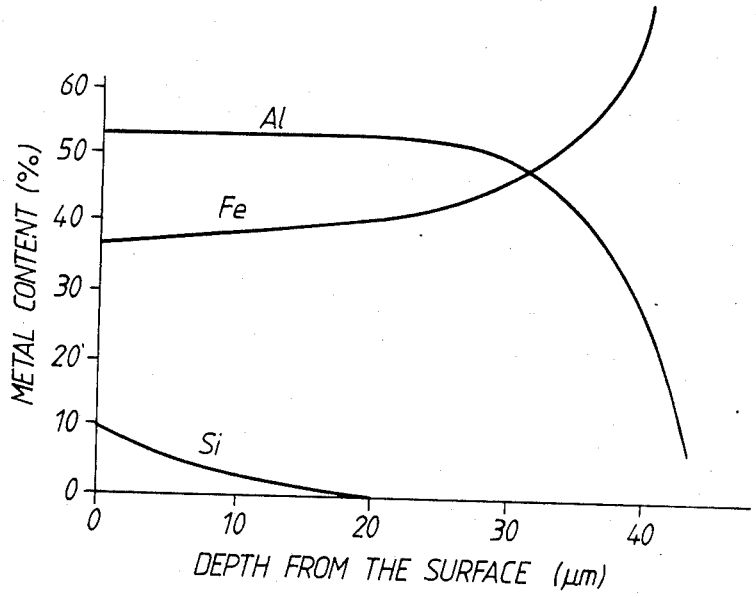
FIG. 4 is a graph showing the profiles of various constituents in the vicinity of a blackened surface region of a metal member.

FIG. 4 shows the profile of the metallic constituents in the vicinity of the blackened region. Depth from the surface of the blackened region is shown along the vertical axis and the metal content is shown along the horizontal axis. As can be seen from this Figure, the maximum Si content is found at the surface.

This blackened region is in the form of a layer but its boundary with the substrate is not well-defined. However, it has considerable adhesion to the substrate, and in a test in which a metal member treated as above was experimentally fitted in a cathode ray tube it was found to be effective in increasing the black body radiation of the metal member, thereby suppressing generation of reflected electrons. This reduction in the number of reflected electrons was apparent from the reduction in dark space luminance achieved by installation of the treated metal member.

Figure 3:
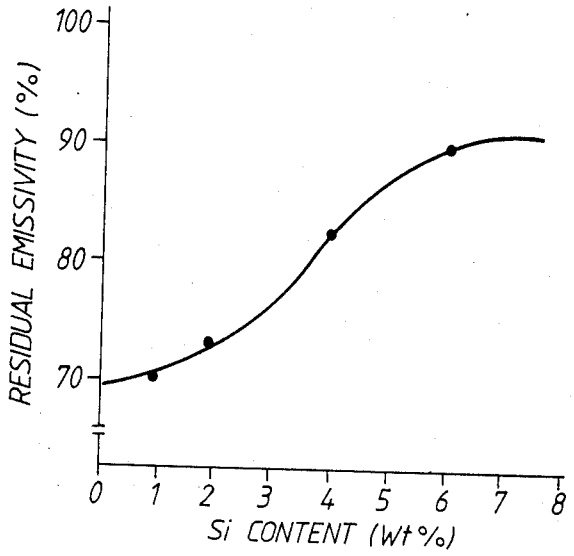
FIG. 3 is a graph of a characteristic curve showing the variation of the residual emission with Si content in the vicinity of a blackened surface region.

It was also found that the extent of the improvement in emission life of the tube was dependent on the composition of the blackened region containing Al, Fe and Si, in particular on its Si content. FIG. 3 shows the relationship between Si content and residual emissivity after a 3000 hour emission life test. From FIG. 3 it is clear that, above a Si content of about 1.5 wt%, the residual emissivity is better than in the case where the blackened region contains no Si.

The reason for this improved emission life is not clear, but from the state of the blackened region and the fact that the Si and Al etc. are present essentially in metallic form, it is inferred that the surface of the blackened region acts as what is known as a getter.

FIG. 3 shows the variation of residual emissivity with Si content (wt%) at the surface of the blackened region. It results in a necessary condition which the Si content is greater than 1.5 wt%. To be a marked improvement in residual emissivity a Si content of at least 4 wt% is desirable. On the other hand, it is not desirable for the Si content to exceed 30 wt%, since above this limit separation of the blackened layer in a cellophane adhesive tape adhesion test tends to occur. (A cellophane adhesive tape adhesion test is carried out by sticking cellophane adhesive tape onto the blackened layer, and observing whether the blackened layer comes away when the tape is peeled off.) The results of the tape adhesion test are shown in the Table 1 below.

TABLE 1

| Si content (%) | Resistance to peeling off |
|---|---|
| 1.5 | good |
| 7.0 | good |
| 15.0 | good |
| 30.0 | peeling off slightly occurred |
| 40.0 | peeling off occurred |

Because of the above, a Si content of 1.5 to 30 wt% preferably 4 to 15 wt%, is specified.

To maintain the properties of the inner shield, the Al and Fe contents of the blackened region are preferably 35 to 65 wt% and 25 to 55 wt%, respectively.

EXAMPLE

An inner shield for a 20-in cathode ray tube was formed using soft steel sheet of thickness 0.3 mm plated with molten Al on both faces. Vacuum heat treatment was then performed at 700° C. at a degree of vacuum of $10^{-4}$ Torr, to form a blackened region consisting of at least Al, Fe and Si on the surface of the inner shield.

The silicon content in the Al on Al plating was about 7 to 8 wt%.

The respective compositions in the vicinity of the surface of the inner shield after formation of the blackened region are shown in Table 2. A conventional example having a blackened film of iron oxide is shown for comparison.

TABLE 2

| surface layer | | composition | | |
|---|---|---|---|---|
| | | Al | Fe | Si |
| surface layer | 4–5 micron | 53 wt % | 38 wt % | 7 wt % |
| surface layer | 20–30 micron | 53 wt % | 43 wt % | 2 wt % |
| (comparative example) | | | | |
| surface layer | 4–5 micron | <0.001 wt % | 99.5 wt % | <0.02 wt % |

This inner shield was mounted in a 20-in color cathode ray tube.

Figure 5:
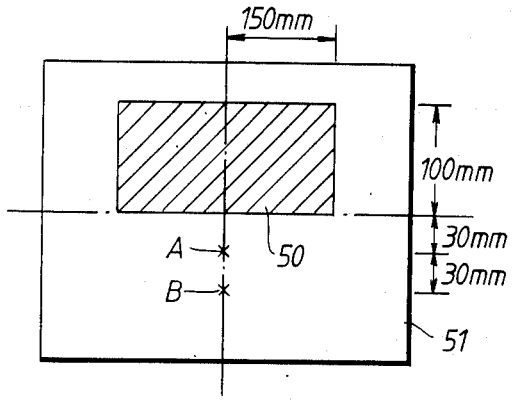
FIG. 5 to FIG. 7 are plan views showing the surface patterns on the screen used to determine the contrast and the amount of displacement of the electron beam.

First of all, the pattern 50 shown in FIG. 5 was displayed and the brightness of the dark region 51 was measured, to determine the degree of contrast produced by the tube. The measurement conditions were: $E_b$=26.5 KV, total $I_k$=500 microampere, white color 9300° K.+27 MPCD.

Table 3 gives the results of determination of dark region 51 luminance at points A and B in FIG. 5, taking the dark region luminance at these points in a conventionally manufactured tube as 100.

TABLE 3

| Subject of determination | Measurement point | |
|---|---|---|
| | $r_f$ = 30(point A) | $r_f$ = 60(point B) |
| Embodiment | 91.7 | 83.8 |
| Comparative example | 100 | 100 |

From Table 3 it can be seen that the dark region luminance of this embodiment of the invention is reduced from what it is in the conventional example.

Next, the residual emissivity after a test of continuous operation for 3000 hours was measured. In the case of a conventional tube this was 70% of the original emissivity, but in the case of a tube manufactured according to this embodiment of the invention it was much improved and was found to be 90% of the original emissivity.

Figure 6:
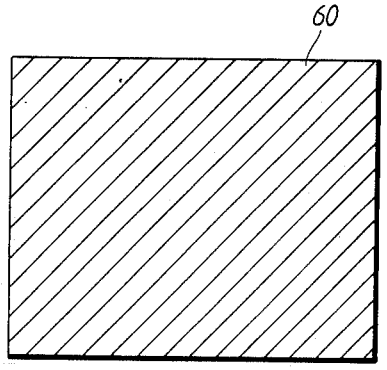
Figure 7:
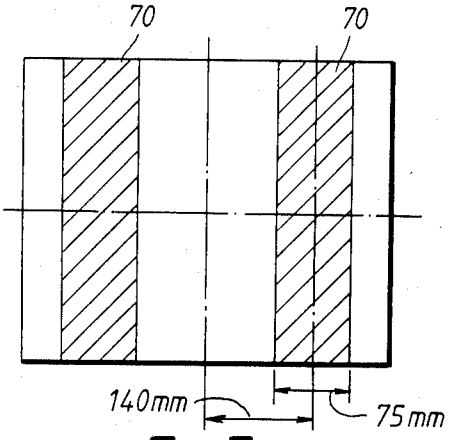

Furthermore, in order to measure the effect on color purity of the doming effect to which shadow masks are subject, the extent of the displacement that took place in the electron beam on changing over from totally illuminated screen display pattern 60 shown in FIG. 6 to display pattern 70 shown in FIG. 7, composed of vertical white bands, at the locations which are most liable to color purity drift due to shadow mask doming, was determined. The shaded regions in the Figures represent illuminated regions of the display. The conditions of measurement were the same as when contrast was measured.

The results are shown in Table 4, taking the values obtained with a conventional tube as 100.

TABLE 4

| Pattern | pattern 60 | pattern 70 |
|---|---|---|
| Embodiment | 84 | 95 |
| Comparative example | 100 | 100 |

As is clear from Table 4, with this embodiment of the invention, the amount of displacement of the electron beam is decreased, enabling color purity to be improved.

As described above, this invention gives a color cathode ray tube with dark region luminance, contrast, color purity and emission life improved.

We claim:

1. A color cathode ray tube comprising:

a panel formed with a phosphor screen on its inside face;

a neck having an electron gun assembly facing said phosphor screen;

a funnel joining said neck to said panel constituting an envelope;

a shadow mask assembly comprising a shadow mask arranged close to and facing the electron gun side of said phosphor screen and a mask frame supporting said shadow mask;

and an inner shield extending on the electron gun side from said shadow mask assembly along the inner face of said funnel, wherein at least one surface of said shadow mask assembly and said inner shield is provided with a blackened region containing Al, Fe and Si, and the Si content in the vicinity of the surface of said blackened region is greater than 1.5 wt% and less than 30 wt%.

2. The color cathode ray tube according to claim 1, wherein the Si content in the vicinity of the surface of said blackened region is greater than 4.0 wt% and less than 15 wt%.

3. The color cathode ray tube according to claim 1, wherein the Si content is a maximum at the surface of said blackened region.

4. The color cathode ray tube according to claim 1, wherein the thickness of the blackened region is from 10 to 20 micron.

* * * * *